US011415016B2

(12) United States Patent
Whittle et al.

(10) Patent No.: US 11,415,016 B2
(45) Date of Patent: Aug. 16, 2022

(54) TURBINE SECTION ASSEMBLY WITH CERAMIC MATRIX COMPOSITE COMPONENTS AND INTERSTAGE SEALING FEATURES

(71) Applicants: Rolls-Royce plc, London (GB); Rolls-Royce North American Technologies Inc., Indianapolis, IN (US)

(72) Inventors: Michael J. Whittle, London (GB); Keith Sadler, London (GB); Ted J. Freeman, Danville, IN (US)

(73) Assignees: Rolls-Royce plc; Rolls-Royce North American Technologies Inc., Indianapolis, IN (US)

( * ) Notice: Subject to any disclaimer, the term of this patent is extended or adjusted under 35 U.S.C. 154(b) by 107 days.

(21) Appl. No.: 16/679,869

(22) Filed: Nov. 11, 2019

(65) Prior Publication Data

US 2021/0140333 A1 May 13, 2021

(51) Int. Cl.
*F01D 11/00* (2006.01)
*F01D 9/04* (2006.01)

(52) U.S. Cl.
CPC ..... *F01D 11/001* (2013.01); *F01D 9/041* (2013.01); *F05D 2230/60* (2013.01); *F05D 2240/55* (2013.01); *F05D 2260/30* (2013.01)

(58) Field of Classification Search
CPC ..... F01D 11/001; F01D 11/02; F01D 5/30; F01D 5/3007; F01D 5/3015; F01D 9/041; F05D 2260/30; F05D 2260/33; F05D 2230/60; F05D 2240/55
See application file for complete search history.

(56) References Cited

U.S. PATENT DOCUMENTS

| | | | | |
|---|---|---|---|---|
| 5,236,302 | A * | 8/1993 | Weisgerber | F01D 11/001 415/173.7 |
| 6,283,712 | B1 | 9/2001 | Dziech et al. | |
| 7,540,709 | B1 | 6/2009 | Ebert | |
| 8,240,986 | B1 | 8/2012 | Ebert | |
| 8,864,451 | B2 | 10/2014 | Piggott et al. | |
| 9,017,013 | B2 | 4/2015 | Laurello et al. | |
| 9,309,783 | B2 | 4/2016 | Nallam et al. | |
| 9,617,867 | B2 | 4/2017 | Maekawa et al. | |
| 9,631,515 | B2 | 4/2017 | Oyarbide et al. | |
| 10,030,538 | B2 | 7/2018 | Hernandez et al. | |
| 10,053,998 | B2 | 8/2018 | Vo et al. | |
| 10,233,764 | B2 | 3/2019 | Thomas et al. | |
| 2005/0201859 | A1 | 9/2005 | Coulon et al. | |
| 2005/0249590 | A1 | 11/2005 | Marchi | |

(Continued)

OTHER PUBLICATIONS

Extended European Search Report, European Application No. 20206449.9-1004, dated Mar. 16, 2021, 8 pages.

*Primary Examiner* — Woody A Lee, Jr.
*Assistant Examiner* — Elton K Wong
(74) *Attorney, Agent, or Firm* — Barnes & Thornburg LLP

(57) ABSTRACT

A turbine assembly for use with a gas turbine engine includes a bladed wheel assembly, a vane assembly, and an inner seal. The bladed wheel assembly is adapted to interact with gases flowing through a gas path of the gas turbine engine. The vane assembly is located upstream of the bladed wheel assembly and adapted to direct the gases at the bladed wheel assembly. The inner seal is configured to block gases from passing around the vane assembly.

20 Claims, 9 Drawing Sheets

(56) References Cited

U.S. PATENT DOCUMENTS

| | | | | |
|---|---|---|---|---|
| 2007/0128021 | A1* | 6/2007 | Klasing | F01D 9/041 415/210.1 |
| 2007/0253822 | A1* | 11/2007 | Buisson | F01D 5/3015 416/219 R |
| 2009/0060722 | A1* | 3/2009 | Cloarec | F04D 29/563 415/160 |
| 2009/0238683 | A1* | 9/2009 | Alvanos | F01D 11/122 415/173.7 |
| 2009/0324388 | A1* | 12/2009 | Takamura | F01D 11/001 415/116 |
| 2016/0290149 | A1* | 10/2016 | Hill | F01D 5/081 |
| 2019/0063234 | A1* | 2/2019 | Satre | F01D 11/001 |
| 2020/0362712 | A1 | 11/2020 | Steedman et al. | |
| 2021/0095568 | A1* | 4/2021 | Hoell | F01D 5/3015 |

* cited by examiner

TURBINE SECTION ASSEMBLY WITH CERAMIC MATRIX COMPOSITE COMPONENTS AND INTERSTAGE SEALING FEATURES

FIELD OF THE DISCLOSURE

The present disclosure relates generally to gas turbine engines, and more specifically to sealing features for use in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors and turbines typically include alternating stages of static vane assemblies and rotating wheel assemblies. Fluid leakage between stages reduces overall gas turbine engine performance and efficiency. As such, some turbine sections include inner seals to reduce such leakage. The inner seals may be coupled to the vane assembly or may engage abradable material coupled to the vane assembly.

However, in ceramic matrix composite vane embodiments, coupling the inner seal to the vane assembly may increase structural loads on the ceramic matrix composite material. Additionally, the vane assembly may use additional seals due to the difference in coefficients of thermal expansion between the metallic materials of the supporting structure and the ceramic materials of the vane. As such, sealing features remain an area of interest for ceramic matrix composite components.

SUMMARY

The present disclosure may comprise one or more of the following features and combinations thereof.

A turbine assembly for use with a gas turbine engine may include a bladed wheel assembly, a vane assembly, and an inner seal. The bladed wheel assembly may be adapted to interact with gases flowing through a gas path of the gas turbine engine. The gases may push the bladed wheel assembly to rotate about an axis during use of the turbine assembly. The vane assembly may be located upstream of the bladed wheel assembly and adapted to direct the gases at the bladed wheel assembly. The inner seal may engage the vane assembly and may be coupled with the bladed wheel assembly for rotation therewith about the axis to block gases from passing between the inner seal and the vane assembly during use of the turbine assembly.

In some embodiments, the bladed wheel assembly may include a disk and a plurality of blades. The disk may be arranged around the axis. The plurality of blades may extend radially from the disk, In some embodiments, the vane assembly may include a vane and an inner support. In some embodiments, the inner support may be located radially inward of the vane and may be coupled with the vane. In some embodiments, the vane assembly may be fixed relative to the axis.

In some embodiments, the vane may include an outer platform, an inner platform, and an airfoil. The inner platform may be spaced apart radially from the outer platform relative to an axis. The airfoil may extend radially between the outer platform and the inner platform. In some embodiments, the inner support may be located radially inward of the inner platform and may be coupled with the vane.

In some embodiments, the inner seal may include a radially and circumferentially extending seal body, a rub band, and a mount ring. The seal body may be fastened with the disk for rotation with the disk. The rub band may be coupled to a radial outer end of the seal body. In some embodiments, the rub band may be engage with the inner support to seal between the rub band and the inner support. The mount ring may extend axially aft and radially inward from the rub band.

In some embodiments, the mount ring may be interlocked with the disk to form a bayonet fitting with the disk. The bayonet fitting may block axial movement of the mount ring away from the disk. The bayonet fitting may also transmit a portion of the force loads caused by rotation of the inner seal to the disk to reduce a magnitude of the force loads carried by the seal body.

In some embodiments, the disk may include a disk body and an outer flange. The disk body may be arranged circumferentially around the axis. The outer flange may extend axially forward from the disk body to define a radially outward opening channel.

In some embodiments, the mount ring may extend radially inward into the channel. In some embodiments, the mount ring may be configured to engage the outer flange so that axial movement of the mount ring is blocked by the outer flange.

In some embodiments, the outer flange may be castellated to define a plurality of disk grooves. The plurality of disk grooves may extend radially inward into the outer flange.

In some embodiments, the mount ring may be castellated to define a plurality of grooves. The plurality of grooves may extend radially outward into the mount ring.

In some embodiments, the disk includes an inner flange. The inner flange may be located radially inward of the outer flange. In some embodiments, the inner flange may extend axially forward from the disk body, and the seal body may be fastened with the inner flange for movement with the inner flange.

In some embodiments, the disk may include a radially inwardly facing shoulder. The radially inwardly facing shoulder may be located radially outward of the outer flange.

In some embodiments, the mount ring may include a radially outward facing shoulder. The radially outwardly facing shoulder may engage the radially inward facing shoulder of the disk to transmit the portion of the force loads in the radial direction.

In some embodiments, the rub band may include a hoop and a plurality of fins. The hoop may extend circumferentially around the axis and axially aft of the seal body. The plurality of fins may extend radially outward from the hoop. In some embodiments, the hoop may interconnect the seal body and the mount ring.

In some embodiments, the inner platform and the inner support may be integrally formed as a single, one-piece component. The integrally formed one-piece component may be separate from the outer platform and the airfoil.

In some embodiments, the rub band may include a hoop, a plurality of forward fins, and a plurality of aft fins. The plurality of forward fins may extend radially outward from the hoop. The plurality of aft fins may extend radially outward from the hoop.

In some embodiments, the hoop may extend circumferentially around the axis and may be coupled with a radial terminal end of the seal body. The plurality of aft fins may be spaced apart axially from the plurality of forward fins to define an annular chamber therebetween.

In some embodiments, the hoop may be formed to define a hole. The hole may extend radially through the hoop and may open into the annular chamber.

In some embodiments, the inner support may be a full hoop and may be formed to define passageways. The passageways may each extend radially inward into the inner support and turn axially aft and open into an aft facing surface of the inner support. The passageways may cause the inner support to act as a pre-swirl nozzle configured to deliver pressurized air to the disk.

According to another aspect of the present disclosure, a turbine assembly for use with a gas turbine engine may include a first bladed wheel assembly, a vane assembly, and an inner seal. The first bladed wheel assembly may include a disk arranged around an axis and a plurality of blades that extend radially from the disk. The vane assembly may include a vane and an inner support located radially inward of the vane and coupled with the vane.

In some embodiments, the inner seal may include a seal body, a rub band, and a mount ring. The seal body may extend circumferentially about the axis. The rub band may extend axially away from a radial outer end of the seal body. The mount ring may extend radially inward from the rub band. In some embodiments, the rub band may extend only in a single axial direction away from the radial outer end of the seal body.

In some embodiments, the seal body may be coupled with the disk of the first bladed wheel assembly. The mount ring may interlock with the disk so that the mount ring is blocked from moving axially away from the disk of the first bladed wheel assembly.

In some embodiments, the turbine assembly may further include a second bladed wheel assembly. The second bladed wheel assembly may be spaced apart axially from the first bladed wheel assembly to locate the inner seal between the first and second bladed wheel assemblies. In some embodiments, only the seal body may engage the second bladed wheel assembly.

In some embodiments, the mount ring may include a lip and a plurality of tabs. The plurality of tabs may extend radially inward from the lip.

In some embodiments, the disk may be formed to include a flange. The flange may have an arm and a plurality of tabs. The plurality of tabs may extend from the arm. In some embodiments, the plurality of tabs of the mount ring may be aligned with the plurality of tabs of the flange to interlock the inner seal with the disk.

In some embodiments, the disk may be formed to include a first plurality of fastener holes. The first plurality of fastener holes may be arranged circumferentially around the axis.

In some embodiments, the seal body may be formed to include a second plurality of fastener holes. The second plurality of fastener holes may be arranged circumferentially around the axis. In some embodiments, the plurality of tabs of the mount ring may be aligned with the plurality of tabs of the flange in response to the fastener holes formed in the seal body being aligned with the fastener holes formed in the disk.

In some embodiments, the rub band may include a hoop, a forward fin, and an aft fin. The forward fin may extend radially away from the hoop and engage the vane assembly. The aft fin may extend radially away from the hoop and engage the vane assembly.

In some embodiments, the hoop may be formed to define a plurality of holes. The plurality of holes may extend radially through the hoop between the forward fin and the aft fin.

In some embodiments, the vane assembly may include an outer platform, an airfoil, and an inner support. The airfoil may extend radially inward from the outer platform.

In some embodiments, the inner support may include an inner platform and an inner carrier. The inner carrier may be located radially inward of the inner platform.

According to another aspect of the present disclosure, a method may include several steps. The method may include providing a bladed wheel assembly, a vane assembly, and an inner seal. The bladed wheel assembly may be arranged around an axis.

In some embodiments, method may further include locating the vane assembly axially adjacent the bladed wheel assembly, aligning the inner seal with the disk along the axis, translating axially the inner seal relative to the disk to cause the inner seal to align axially with and engage the vane assembly, rotating the inner seal relative to the disk partway about the axis to cause the inner seal to interlock with the disk after the translating step, and fixing the inner seal with the disk for rotational movement with the disk after the rotating step. In some embodiments, the fixing step may include inserting fasteners into the inner seal and the bladed wheel assembly so that that inner seal is blocked from rotating relative to the bladed wheel assembly.

In some embodiments, the vane assembly may include a vane and a pre-swirl nozzle. The pre-swirl nozzle may be coupled to a radial inner end of the vane. In some embodiments, the method may further include engaging the inner seal with the pre-swirler and directing pressurized air radially through the vane, through the pre-swirler, and axially toward the disk via an outlet of the pre-swirler.

In some embodiments, the inner seal may include a seal body, a rub band, and a mount ring. The seal body may extend circumferentially about the axis. The rub band may extend axially away from a radial outer end of the seal body. The mount ring may extend radially inward from the rub band.

In some embodiments, the rub band may include a hoop, a forward fin, and an aft fin. The forward fin may extend radially away from the hoop and engage the vane assembly. The aft fin may extend radially away from the hoop and engage the vane assembly.

In some embodiments, the hoop may be formed to define a plurality of holes. The holes may extend radially through the hoop between the forward fin and the aft fin.

These and other features of the present disclosure will become more apparent from the following description of the illustrative embodiments.

DETAILED DESCRIPTION OF THE DRAWINGS

Figure 1:
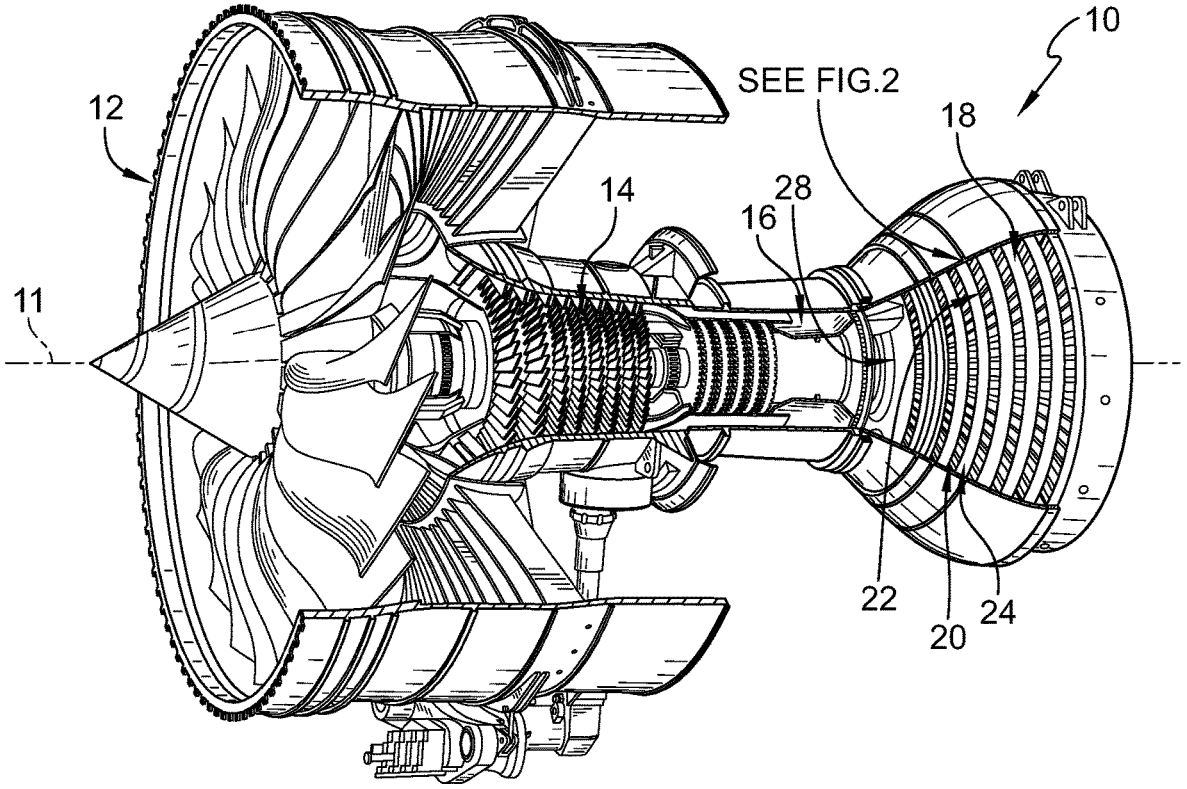
FIG. 1 is a cutaway view of a gas turbine engine that includes a fan, a compressor, a combustor, and a turbine assembly, the turbine assembly including rotating wheel assemblies configured to rotate about an axis of the engine and static turbine vane assemblies configured to direct air into downstream rotating wheel assemblies.

For the purposes of promoting an understanding of the principles of the disclosure, reference will now be made to a number of illustrative embodiments illustrated in the drawings and specific language will be used to describe the same.

Figure 2:
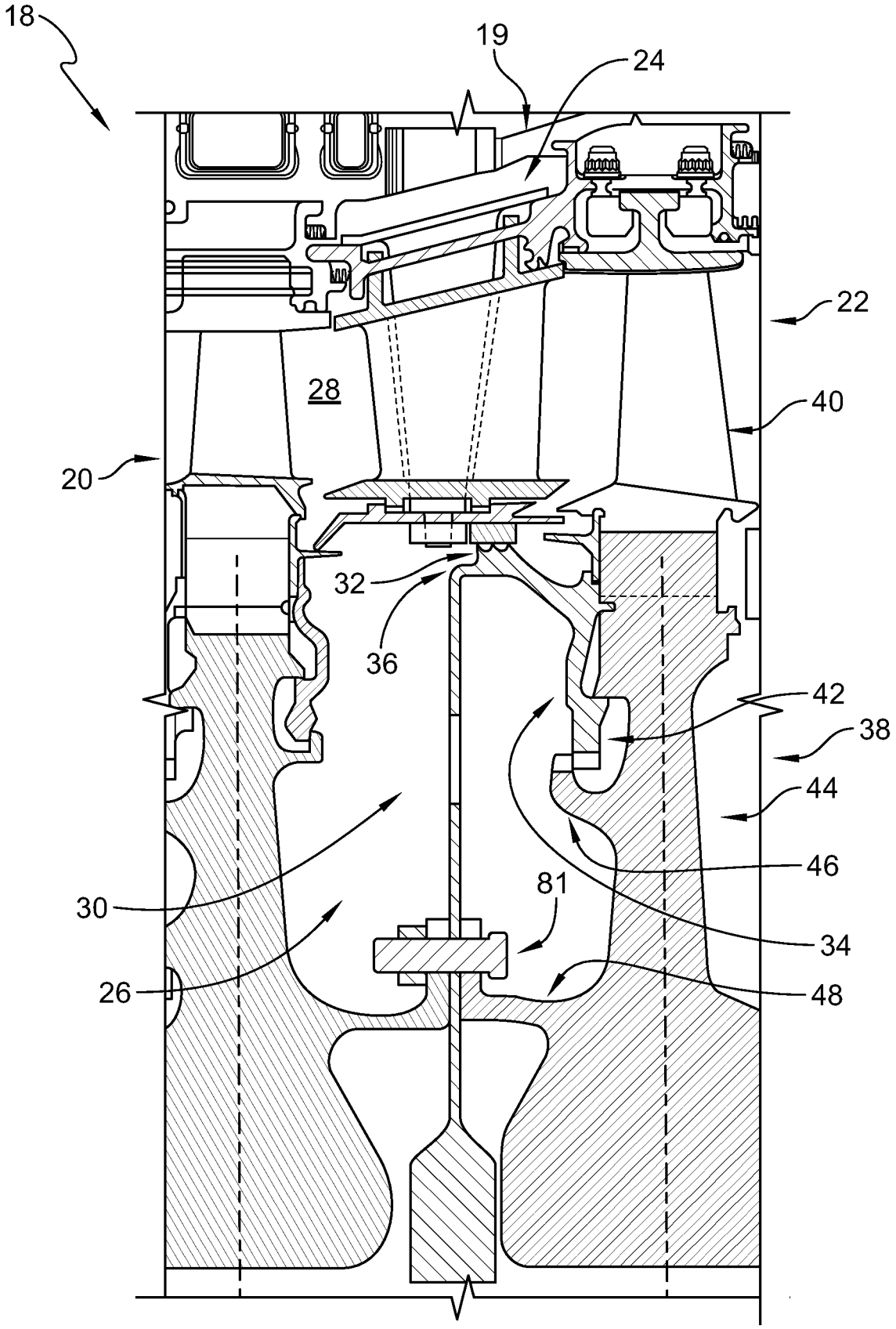
FIG. 2 is section view of a portion of the turbine assembly included in the gas turbine engine of FIG. 1 showing the turbine assembly further includes a rotating inner seal that engages one of the vane assemblies and is coupled with one of the bladed wheel assemblies for rotation therewith about the axis to block gases from passing between the vane assembly and the bladed wheel assembly.

A turbine assembly 18 for use with a gas turbine engine 10 is shown in FIG. 2. The turbine assembly 18 includes a bladed wheel assembly 22, a vane assembly 24, and an inner seal 26 as shown in FIG. 2. The bladed wheel assembly 22 is adapted to interact with gases flowing through a gas path 28 of the gas turbine engine 10 such that the gases push the bladed wheel assembly 22 to rotate about an axis 11 during use of the turbine assembly 18. The vane assembly 24 is located upstream of the bladed wheel assembly 22 and adapted to direct the gases at the bladed wheel assembly 22. The inner seal 26 is engaged with the vane assembly 24 and coupled with the bladed wheel assembly 22 for rotation with the bladed wheel assembly 22 about the axis 11 to block gases from passing between the inner seal 26 and the vane assembly 24 during use of the turbine assembly 18.

Figure 3:
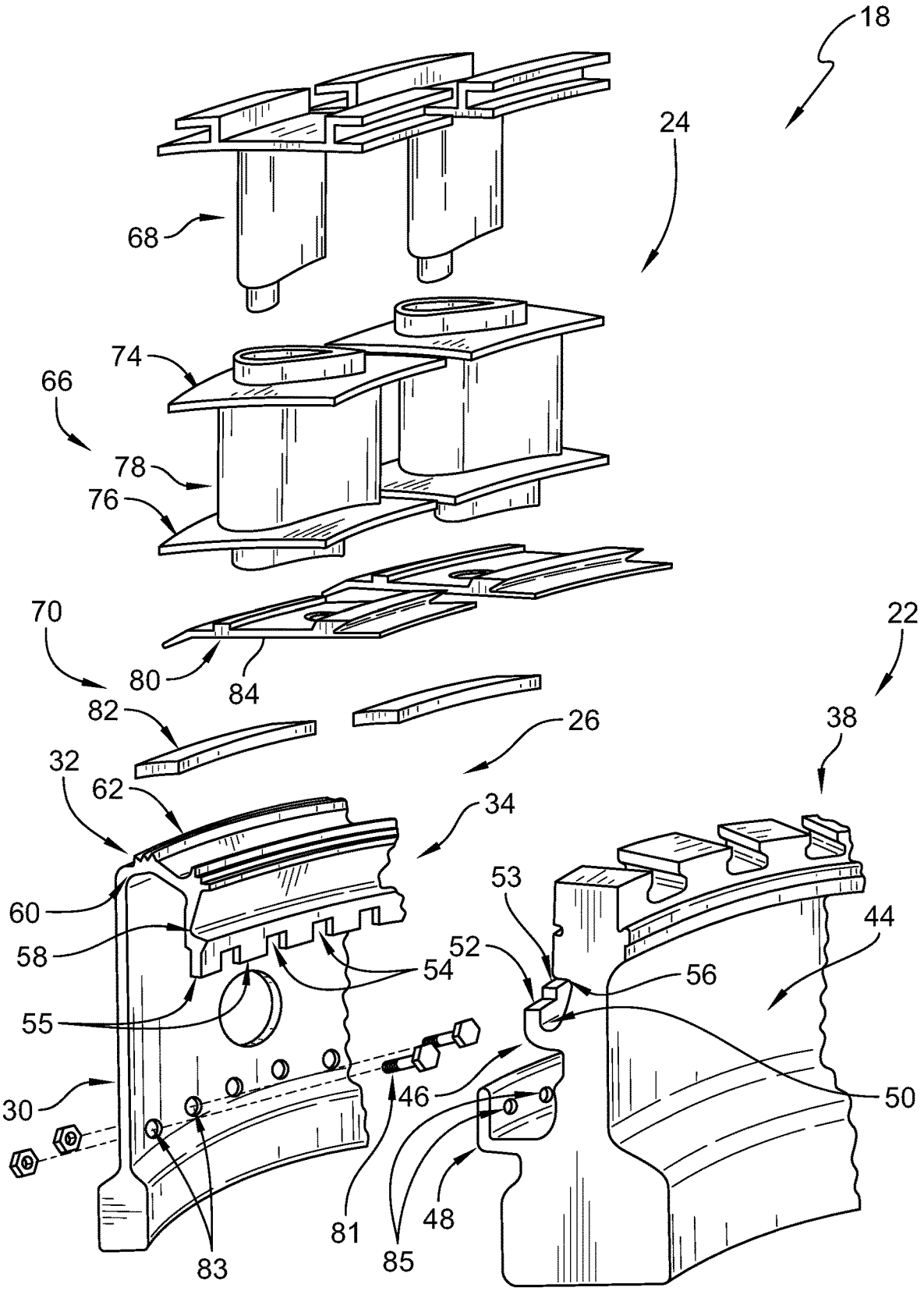
FIG. 3 is an exploded view of the turbine assembly included in the gas turbine engine of FIG. 1 showing the inner seal includes a seal body adapted to couple to the wheel assembly, a rub band adapted to engage with the vane assembly to seal between the vane assembly and the bladed wheel assembly, and a mount ring that extends axially aft and radially inward from the rub band to engage the bladed wheel assembly to block axial movement of the mount ring away from the bladed wheel assembly.

The inner seal 26 includes a radially and circumferentially extending seal body 30, a rub band 32, and a mount ring 34 as shown in FIGS. 2 and 3. The seal body 30 is fastened with a disk 38 of the bladed wheel assembly 22 for rotation with the disk 38. The rub band 32 is coupled to a radial outer end 36 of the seal body 30 and engaged with the vane assembly 24 to seal between the rub band 32 and the vane assembly 24. The mount ring 34 extends axially aft and radially inward from the rub band 32.

In the illustrative embodiment, the mount ring 34 is interlocked with the disk 38 to form a bayonet fitting 42 with the disk 38 as shown in FIG. 2. The bayonet fitting 42 blocks axial movement of the mount ring 34 away from the disk 38 and transmits a portion of the force loads caused by rotation of the inner seal 26 to the disk 38. Transmitting a portion of the force loads to the disk 38 reduces a magnitude of the force loads carried by the seal body 30.

In some gas turbine engines, an inner seal may be coupled to a metallic support that couples a vane assembly to an associated turbine case to seal between the adjacent vane assembly and the bladed wheel assembly. In such embodiments, the vane assembly may include several seals to seal between the plurality of joints between the different components. Effectively sealing the plurality of joints may be difficult in cases where the joints are between a metallic component and a ceramic matrix composite component due to coefficient of thermal expansion mismatch between the two materials. The inner seal 26 of the present disclosure is separately supported from the vane assembly 24 and therefore reduces the number of metal to ceramic joints in the assembly, improving overall sealing and engine performance.

The turbine assembly 18 is adapted for use in the gas turbine engine 10, which includes a fan 12, a compressor 14, a combustor 16, and the turbine assembly 18 as shown in FIG. 1. The fan 12 is driven by the turbine assembly 18 and provides thrust for propelling an aircraft. The compressor 14 compresses and delivers air to the combustor 16. The combustor 16 mixes fuel with the compressed air received from the compressor 14 and ignites the fuel. The hot, high pressure products of the combustion reaction in the combustor 16 are directed into the turbine assembly 18 to cause the turbine assembly 18 to rotate about the axis 11 of the gas turbine engine 10 and drive the compressor 14 and the fan 12. In the illustrative embodiment, the turbine assembly 18 includes a turbine case 19, the plurality of static vane assemblies 24 that are fixed relative to the axis 11, and a plurality of bladed rotating wheel assemblies 20, 22 as suggested in FIG. 2.

Figure 4:
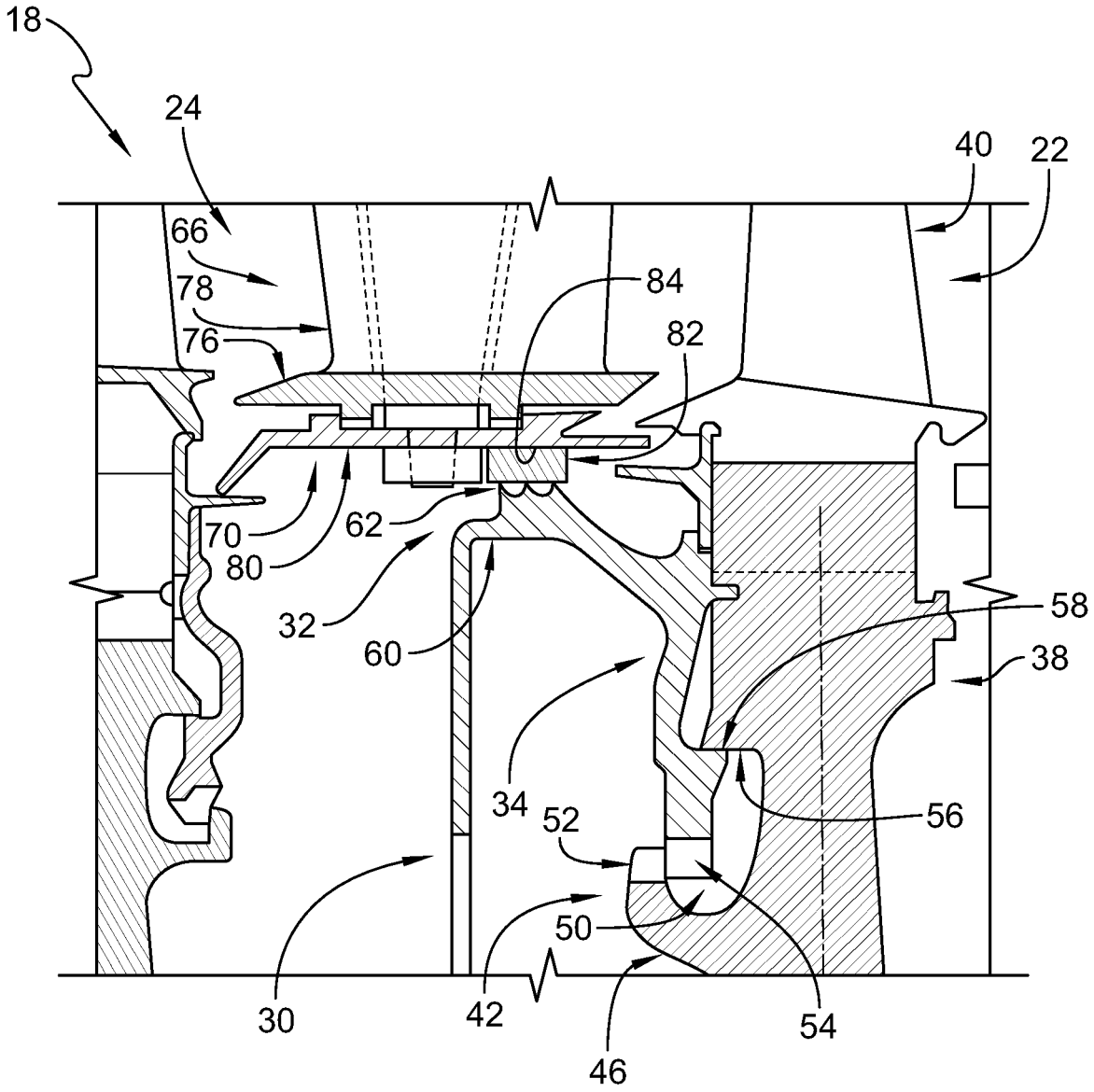
FIG. 4 is a detail view of the turbine assembly of FIG. 2 showing the mount ring interlocked with a disk of the bladed wheel assembly to form a bayonet fitting with the disk and to transmit a portion of the force loads caused by rotation of the inner seal to the disk.

The bladed wheel assembly 22 includes the disk 38 and a plurality of blades 40. The disk 38 is arranged around the axis 11. The plurality of blades 40 are coupled with and extend radially from the disk 38. The disk 38 includes a disk body 44, an outer flange 46, and an inner flange 48 as shown in FIGS. 2-4. The disk body 44 is arranged circumferentially around the axis 11. The outer flange 46 extends axially forward from the disk body 44 to define a radially outward opening channel 50. The inner flange 48 is located radially inward of the outer flange 46 and extends axially forward from the disk body 44.

In the illustrative embodiment, the mount ring 34 extends radially inward into the channel 50 as shown in FIGS. 3 and 4. The mount ring 34 is configured to engage the outer flange 46 of the disk 38 so that axial movement of the mount ring 34 is blocked by the outer flange 46. Additionally, the seal body 30 is fastened with the inner flange 48 for movement with the inner flange 48.

In the illustrative embodiment, the outer flange 46 is castellated to define a plurality of disk grooves 52, and the mount ring 34 is castellated to define a plurality of ring grooves 54 as shown in FIGS. 3 and 4. The disk grooves 52 extend radially inward into the outer flange 46 to form a plurality of disk tabs 53. The ring grooves 54 extend radially outward into the mount ring 34 to form a plurality of ring tabs 55.

In the illustrative embodiment, the disk tabs 53 are sized to fit into the ring grooves 54, while the ring tabs 55 are sized to fit into the disk grooves 52 such that the together the tabs 53, 55 so that the mount ring 34 may be coupled to the disk 38 and form the bayonet fitting 42. Once assembled, the disk tabs 53 and the ring tabs 55 engage one another to couple the mount ring 34 and the disk 38 together and block axial movement of the mount ring 34.

In the illustrative embodiment, the disk 38 further includes a radially inwardly facing shoulder 56 as shown in FIGS. 2 and 3. The shoulder 56 of the disk 38 is located radially outward of the outer flange 46. In the illustrative embodiment, the mount ring 34 further includes a radially outward facing shoulder 58 as shown in FIGS. 2-4. The shoulder 58 of the mount ring 34 engages the radially inwardly facing shoulder 56 of the disk 38 to transmit the portion of the force loads in the radial direction.

The rub band 32 includes a hoop 60 and a plurality of fins 62 as shown in FIGS. 2-4. The hoop 60 extends circumferentially around the axis 11 and axially aft of the seal body 30. The plurality of fins 62 extend radially outward from the hoop 60. In the illustrative embodiment, the hoop 60 interconnects the seal body 30 and the mount ring 34.

Turning again to the vane assembly 24, the vane assembly 24 includes a vane 66, an outer support 68, and an inner support 70 as shown in FIGS. 2-4. The vane 66 is positioned to direct the gases toward the bladed wheel assemblies 22 with a desired orientation. The outer support 68 is located radially outward of the vane 66, while the inner support 70 is spaced apart radially from the outer support 68 relative to the axis 11 of the gas turbine engine 10 to locate the vane 66 radially between.

The vane 66 includes an outer platform 74, an inner platform 76, and an airfoil 78 as shown in FIGS. 3 and 4. The inner platform 76 is spaced apart radially from the outer platform 74 relative to the axis 11. The airfoil 78 extends radially between the outer platform 74 and the inner platform 76. In the illustrative embodiment, the inner support 70 is located radially inward of the inner platform 76 and coupled with the outer support 68.

The inner support 70 includes an inner carrier 80 and an abradable band 82 as shown in FIGS. 3 and 4. The inner carrier 80 is located radially inward of the inner platform 76 of the vane 66. The abradable band 82 is coupled to the inner carrier 80 on a radially-inwardly facing surface 84 of the inner carrier 80 and is engaged by the fins 62 of the rub band 32.

In the illustrative embodiment, the abradable band 82 is segmented as shown in FIG. 3. In other embodiments, the inner support 70 may 326 include a full hoop abradable band 82 coupled to the segmented inner carriers 80.

In the illustrative embodiment, the seal body 30 is formed to include a plurality of fastener holes 83 arranged circumferentially around the axis 11 as shown in FIG. 3. The plurality of fastener holes 83 align a plurality of fastener holes 85 formed in the disk 38 to receive a fastener 81. In the illustrative embodiment, the ring tabs 55 of the mount ring 34 are aligned with the disk tabs 53 of the flange 46 in response to the fastener holes 83 formed in the seal body 30 being aligned with the fastener holes 85 formed in the disk 38.

A method of assembling and using the turbine assembly 18 may include several steps. The method includes locating the vane assembly 24 axially adjacent to the bladed wheel assembly 22 and aligning the inner seal 26 with the disk 38 along the axis 11. The aligning step includes lining up the disk grooves 52 with the ring tabs 55 of the mount ring 34 and the ring grooves 54 with the disk tabs 53 of the outer flange 46.

Once, the inner seal 26 is aligned with the disk 38, the method continues by translating the inner seal 26 axially relative to the disk 38 to cause the inner seal 26 to align axially with and engage the vane assembly 24. The translating step causes the tabs 53 to move through the ring grooves 54 and the tabs 55 through the disk grooves 52 so that the mount ring 34 is located in the channel 50.

After the translating step, the method further includes rotating the inner seal 26 relative to the disk 38 partway about the axis 11 to cause the inner seal 26 to interlock with the disk 38. The rotating step causes the disk tabs 53 to engage the ring tabs 55 and block axial movement of the inner seal 26. Then, the inner seal 26 is fixed with the disk 38 for rotational movement with the disk 38. In the illustrative embodiment, the fixing step includes inserting fasteners 81 into the inner seal 26 and the bladed wheel assembly 22 so that that inner seal 26 is blocked from rotating relative to the bladed wheel assembly 22.

Figure 5:
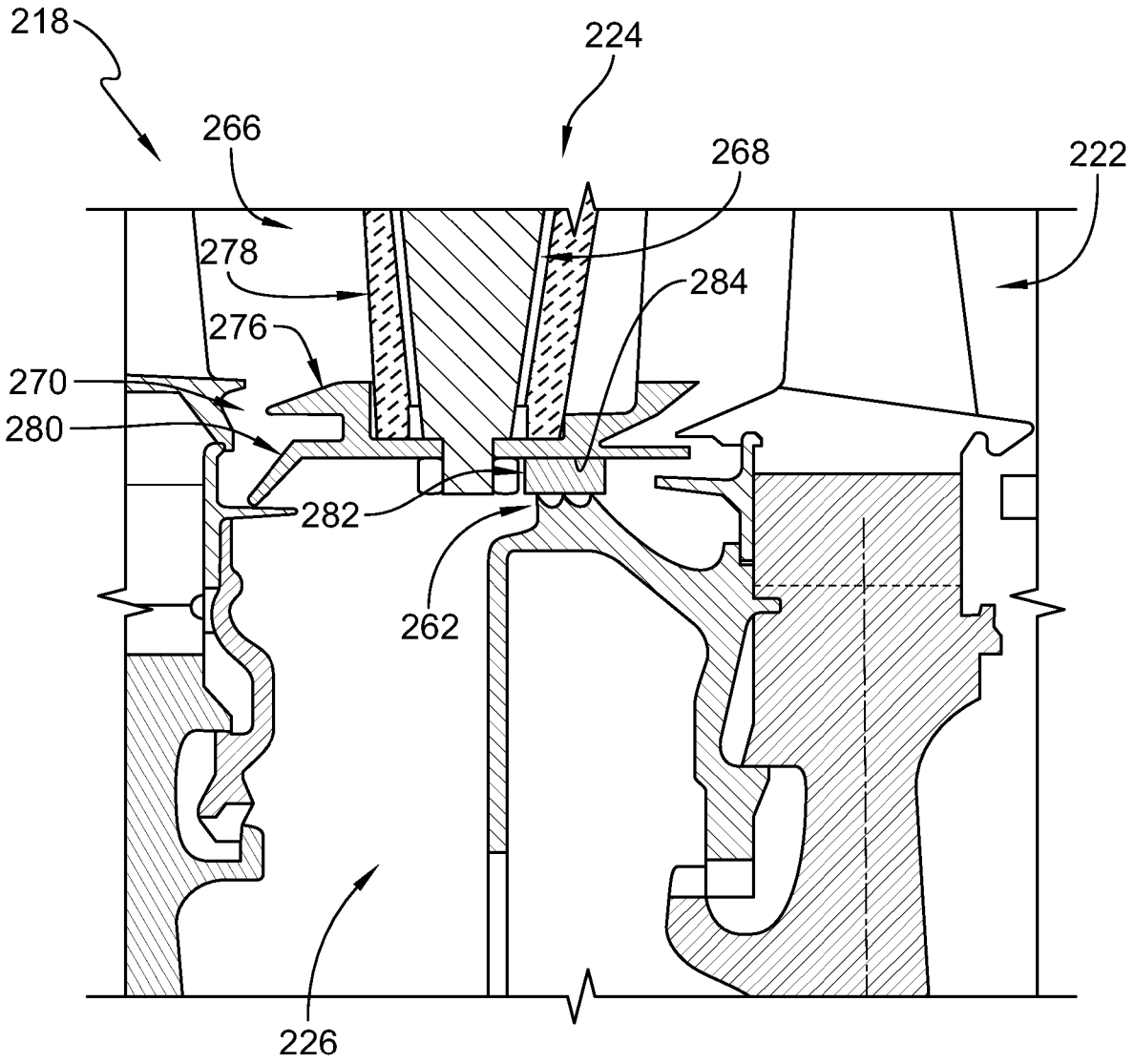
FIG. 5 is another embodiment of a turbine assembly adapted for use in the gas turbine engine of FIG. 1 showing the turbine assembly includes a vane assembly, a bladed wheel assembly, and an inner seal that seals between the vane assembly and the bladed wheel assembly, and further showing the vane assembly includes a vane and an inner support that forms an inner platform of the vane.

Another embodiment of a turbine assembly 218 in accordance with the present disclosure is shown in FIG. 5. The turbine assembly 218 is substantially similar to the turbine assembly 18 shown in FIGS. 2-4 and described herein. Accordingly, similar reference numbers in the 200 series indicate features that are common between the turbine assembly 18 and the turbine assembly 218. The description of the turbine assembly 18 is incorporated by reference to apply to the turbine assembly 218, except in instances when it conflicts with the specific description and the drawings of the turbine assembly 218.

The turbine assembly 218 includes a bladed wheel assembly 222, a vane assembly 224, and an inner seal 226 as shown in FIG. 5. The bladed wheel assembly 222 is adapted to interact with gases flowing through the gas path 28 of the gas turbine engine 10. The vane assembly 224 is located upstream of the bladed wheel assembly 222 and adapted to direct the gases at the bladed wheel assembly 222. The inner seal 226 is engaged with the vane assembly 224 and coupled with the bladed wheel assembly 222 for rotation therewith to block gases from passing between the inner seal 226 and the vane assembly 224 during use of the turbine assembly 218.

The vane assembly 224 includes a vane 266, an outer support 268, and an inner support 270 as shown in FIG. 5. The vane 266 is positioned to direct the gases toward the bladed wheel assemblies 222 with a desired orientation. The outer support 268 is located radially outward of the vane 266 and extends radially through the vane 266, while the inner support 270 is spaced apart radially from the outer support 68 relative to the axis 11 of the gas turbine engine 10 to locate the vane 266 radially between.

The vane 266 includes an outer platform (not shown) and an airfoil 278 as shown in FIG. 5. The outer platform and the airfoil 278 comprising ceramic matrix composite materials. The airfoil 278 extends radially between the outer platform and the inner support 270. In the illustrative embodiment, a portion of the airfoil 278 is received in the inner support 270.

The inner support 270 includes an inner platform 276, an inner carrier 280, and an abradable band 282 as shown in FIG. 5. The inner platform 276 is spaced apart radially from the outer platform relative to the axis 11. The inner carrier 280 is located radially inward of the inner platform 276. The abradable band 282 is coupled to the inner carrier 280 on a radially-inwardly facing surface 284 of the inner carrier 280 and is engaged by fins 262 of the inner seal 226.

In the illustrative embodiment, inner platform 276 and the inner support 270 are integrally formed as a single, one-piece component that is separate from the outer platform and the airfoil 278. The portion of the airfoil 278 received in the inner support 270 extends radially into the one-piece component such that the inner platform 276 comprising metallic materials forms the inner platform 276 of the vane 266.

Figure 6:
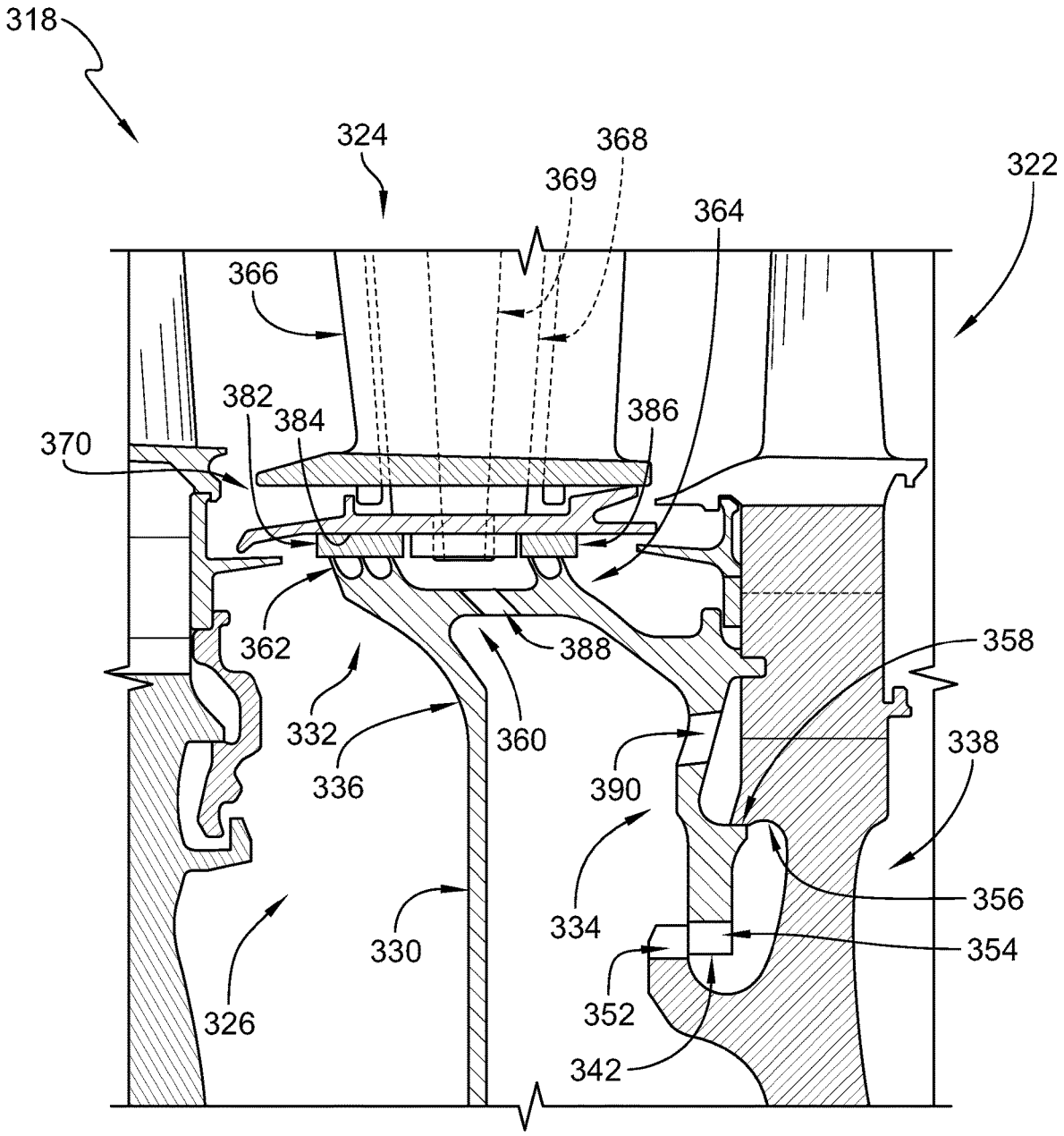
FIG. 6 is another embodiment of a turbine assembly adapted for use in the gas turbine engine of FIG. 1 showing the turbine assembly includes a vane assembly, a bladed wheel assembly, and an inner seal having a seal body, a rub band, and a mount ring that extends to and engages the bladed wheel assembly to block axial movement of the mount ring away from the bladed wheel assembly, and further showing the rub band includes forward and aft fins that extend to and engage the vane assembly to seal between the vane assembly and the bladed wheel assembly.

Another embodiment of a turbine assembly 318 in accordance with the present disclosure is shown in FIG. 6. The turbine assembly 318 is substantially similar to the turbine assembly 18 shown in FIGS. 2-4 and described herein. Accordingly, similar reference numbers in the 300 series indicate features that are common between the turbine assembly 18 and the turbine assembly 318. The description of the turbine assembly 18 is incorporated by reference to apply to the turbine assembly 318, except in instances when it conflicts with the specific description and the drawings of the turbine assembly 318.

The turbine assembly 318 includes a bladed wheel assembly 322, a vane assembly 324, and an inner seal 326 as shown in FIG. 6. The bladed wheel assembly 322 is adapted to interact with gases flowing through the gas path 28 of the gas turbine engine 10. The vane assembly 324 is located upstream of the bladed wheel assembly 322 and adapted to direct the gases at the bladed wheel assembly 322. The inner seal 326 is engaged with the vane assembly 324 and coupled with the bladed wheel assembly 322 for rotation therewith to block gases from passing between the inner seal 326 and the vane assembly 324 during use of the turbine assembly 318.

The vane assembly 324 includes a vane 366 and an inner support 370 as shown in FIG. 6. The vane 366 is positioned to direct the gases toward the bladed wheel assemblies 322 with a desired orientation. The outer support 368 extends through the vane 366 and is formed to include a channel 369 that is configured to supply a flow of pressurized air radially inward of the vane 366. The inner support 370 is located radially inward from the vane 366 and coupled with the outer support 368.

The inner seal 326 includes a radially and circumferentially extending seal body 330, a rub band 332, and a mount ring 334 as shown in FIG. 6. The seal body 330 is fastened with a disk 338 of the bladed wheel assembly 322 for rotation with the disk 338. The rub band 332 is coupled to a radial outer end 336 of the seal body 330 and engaged with the vane assembly 324 to seal between the rub band 332 and the vane assembly 324. The mount ring 334 extends axially aft and radially inward from the rub band 332.

In the illustrative embodiment, the mount ring 334 is interlocked with the disk 338 to form a bayonet fitting 342 with the disk 338 as shown in FIG. 6. The bayonet fitting 342 blocks axial movement of the mount ring 334 away from the disk 338 and transmits a portion of the force loads caused by rotation of the inner seal 326 to the disk 338. Transmitting a portion of the force loads to the disk 338 reduces a magnitude of the force loads carried by the seal body 330.

The rub band 332 includes a hoop 360 and a plurality of fins 362, 364 as shown in FIG. 6. The hoop 360 extends circumferentially around the axis 11 and axially aft of the seal body 330. The plurality of fins 362 extend radially outward from the hoop 360. In the illustrative embodiment, the hoop 360 interconnects the seal body 330 and the mount ring 334.

In the illustrative embodiment, the plurality of fins 362, 364 includes a forward fin 362 and an aft fin 364 as shown in FIG. 6. The forward fins 362 extends radially away from the hoop 360 and engages the vane assembly 324. The aft fins 364 extend radially away from the hoop 360 and engages the vane assembly 324. The forward fins 362 and the aft fins 364 engage the vane assembly 324 to form an inner cavity between the vane assembly 324 and the rub band 332. In the illustrative embodiment, the inner cavity is supplied a flow of pressurized air through the outer support 368.

In the illustrative embodiment, the hoop 360 is formed to define a plurality of holes 388 as shown in FIG. 6. The holes 388 extend radially through the hoop 360 between the forward fin 362 and the aft fin 364. The hole 388 is configured to transmit the flow of pressurized air. The holes 388 allow the flow of pressurized air to flow into the inter disk cavity formed by the inner seal 326.

The mount ring 334 includes a plurality of ring grooves 352, a radially outward facing shoulder 358, and a plurality of holes 390 as shown in FIG. 6. The mount ring 334 is castellated to define the plurality of ring grooves 354 that extend radially outward into the mount ring 334. The shoulder 358 of the mount ring 334 engages a radially inward facing shoulder 356 of the disk 338 to transmit the portion of the force loads in the radial direction. The plurality of holes 390 extend axially through the mount ring 334 radially outward of the shoulder 358 in the illustrative embodiment. The hole 390 is configured to transmit the flow of pressurized air to feed the blades of the bladed wheel assembly 322.

The inner support 370 includes an inner carrier 380, a first abradable band 382, and a second abradable band 386 as shown in FIG. 6. The inner carrier 380 is located radially inward of the vane 366. The first abradable band 382 is coupled to the inner carrier 380 on a radially-inwardly facing surface 384 of the inner carrier 380 and is engaged by the forward fins 362 of the rub band 332. The second abradable band 386 is spaced apart axially from the first abradable band 382 and is coupled to the surface 384 of the inner carrier 380. The second abradable band 386 is engaged by the aft fins 364 of the rub band 332.

Figure 7:
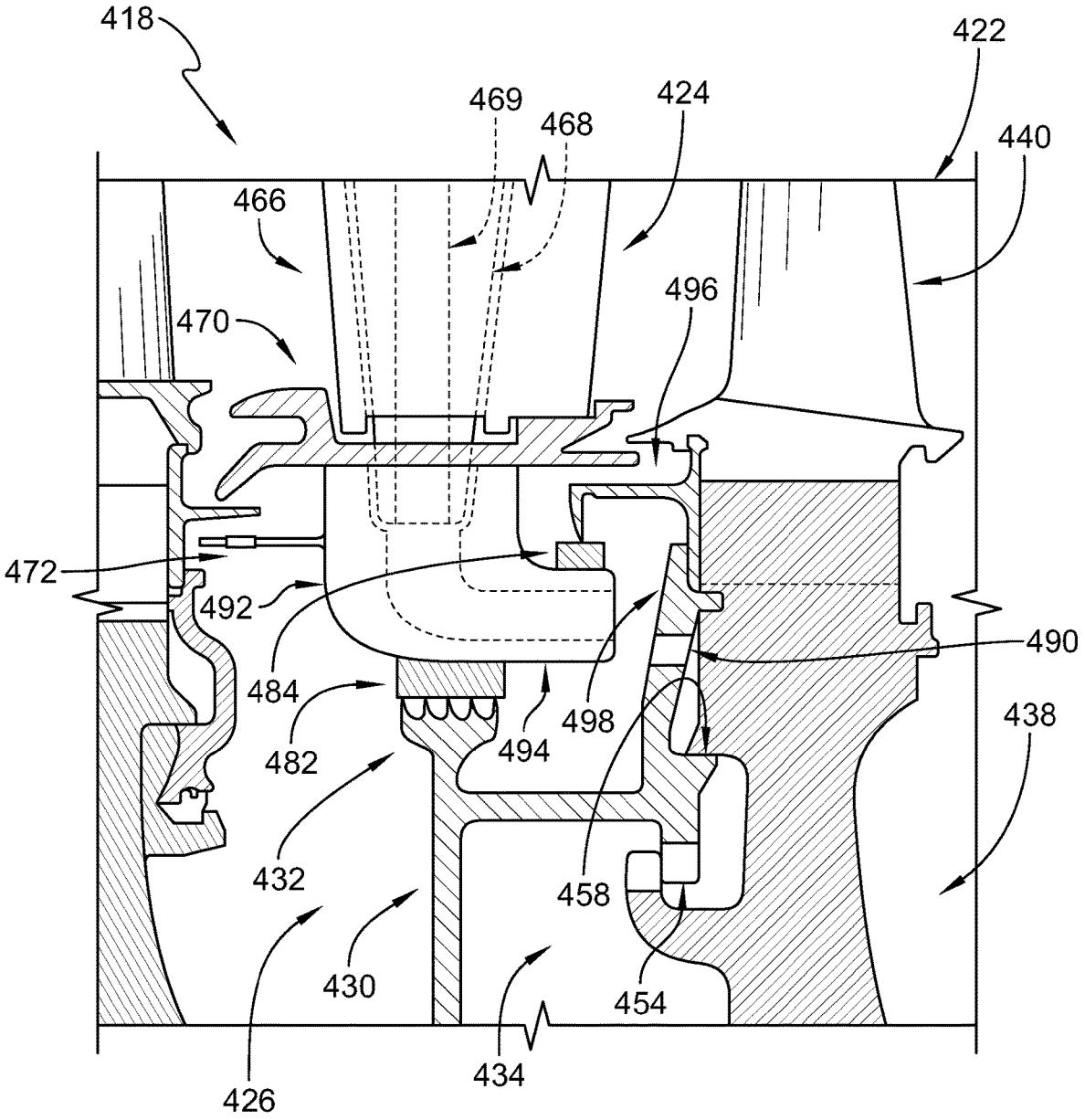
FIG. 7 is another embodiment of a turbine assembly adapted for use in the gas turbine engine of FIG. 1 showing the turbine assembly includes a vane assembly, a bladed wheel assembly, and an inner seal that seals between the vane assembly and the bladed wheel assembly, and further showing the vane assembly includes a vane and an inner support that is a full hoop and forms a pre-swirl nozzle configured to deliver pressurized air to the bladed wheel assembly.

Another embodiment of a turbine assembly 418 in accordance with the present disclosure is shown in FIG. 7. The turbine assembly 418 is substantially similar to the turbine assembly 18 shown in FIGS. 2-4 and described herein. Accordingly, similar reference numbers in the 400 series indicate features that are common between the turbine assembly 18 and the turbine assembly 418. The description of the turbine assembly 18 is incorporated by reference to apply to the turbine assembly 418, except in instances when it conflicts with the specific description and the drawings of the turbine assembly 418.

The turbine assembly 418 includes a bladed wheel assembly 422, a vane assembly 424, and an inner seal 426 as shown in FIG. 6. The bladed wheel assembly 422 is adapted to interact with gases flowing through the gas path 28 of the gas turbine engine 10. The vane assembly 424 is located upstream of the bladed wheel assembly 422 and adapted to direct the gases at the bladed wheel assembly 422. The inner seal 426 is engaged with the vane assembly 424 and coupled with the bladed wheel assembly 422 for rotation therewith to block gases from passing between the inner seal 426 and the vane assembly 424 during use of the turbine assembly 418.

The vane assembly 424 includes a vane 466, an outer support 468, an inner support 470, and a pre-swirl nozzle 472 as shown in FIG. 7. The vane 466 is positioned to direct the gases toward the bladed wheel assemblies 422. The outer support 468 is located radially outward of the vane 466, while the inner support 470 is spaced apart radially from the outer support 468 relative to the axis 11 of the gas turbine engine 10 to locate the vane 466 radially between. The outer support 468 extends through the vane 466 and is formed to include a channel 469 that is configured to supply a flow of pressurized air radially inward of the vane 466. The pre-swirl nozzle 472 is coupled to a radial inner end of the outer support 468 to receive the flow of pressurized air.

The inner support 470 that includes an inner platform 476 and an inner carrier 480 as shown in FIG. 7. The inner carrier 480 is located radially inward of the inner platform 476. In the illustrative embodiment, the inner platform 476 and the inner carrier 480 are integrally formed as a single, one-piece component that is separate from the vane 466.

The pre-swirl nozzle 472 includes a body 492 and a spout 494 as shown in FIG. 7. The body 492 couples to the radial inner end of the outer support 468. The spout 494 extends axially aft from the body 492 to direct a flow of pressurized air at the bladed wheel assembly 422.

The inner seal 426 includes a seal body 430, a rub band 432, and a mount ring 434 as shown in FIG. 6. The seal body 430 is fastened with a disk 438 of the bladed wheel assembly 422 for rotation with the disk 438. The rub band 432 is coupled to a radial outer end 436 of the seal body 430 and engaged with the vane assembly 424 to seal between the rub band 432 and the vane assembly 424. The mount ring 434 extends axially aft and radially inward from the rub band 432.

The rub band 432 includes a hoop 460 and a plurality of fins 462, 464 as shown in FIG. 7. The hoop 460 extends circumferentially around the axis 11 and axially aft of the seal body 430. The fin 462 extends radially outward from the hoop 460. In the illustrative embodiment, the hoop 460 interconnects the seal body 430 and the mount ring 434.

In the illustrative embodiment, the vane assembly 424 further includes an abradable band 482 as shown in FIG. 7. The abradable band 482 is coupled to the pre-swirl nozzle 472 and interfaces the fins 462. In the illustrative embodiment, the hoop 460 is formed to define a plurality of holes 488 as shown in FIG. 7. The holes 488 extend radially through the hoop 460 between the forward fin 462 and the aft fin 464.

The mount ring 434 includes a plurality of ring grooves 454, a radially outward facing shoulder 458, and a plurality of holes 490 as shown in FIG. 6. The mount ring 434 is castellated to define the plurality of ring grooves 454 that extend radially outward into the mount ring 434. The shoulder 458 of the mount ring 434 engages a radially inward facing shoulder 456 of the disk 438 to transmit the portion of the force loads in the radial direction. The plurality of holes 490 extend axially through the mount ring 434 radially outward of the shoulder 458 in the illustrative embodiment.

In the illustrative embodiment, the inner seal 426 further includes a knife seal 496 as shown in FIG. 7. The knife seal 496 is coupled to the disk 438 of the bladed wheel assembly 422 and extends axially forward from the disk 438. In the illustrative embodiment, the mount ring 434 forms a radial extension 498 that extends over a portion of the knife seal 496 to block removal of the knife seal 496 away from the disk 438. In some embodiments, the knife seal 496 acts as a cover plate for the disk 438 to block axial movement of the blades 440 from the disk 438.

In the illustrative embodiment, the vane assembly 424 further includes a second abradable band 484 as shown in FIG. 7. The abradable band 484 is coupled to the spout 494 of the nozzle 472. The knife seal 496 engages the abradable band 484 to seal between the bladed wheel assembly 422 and the nozzle 472.

Figure 8:
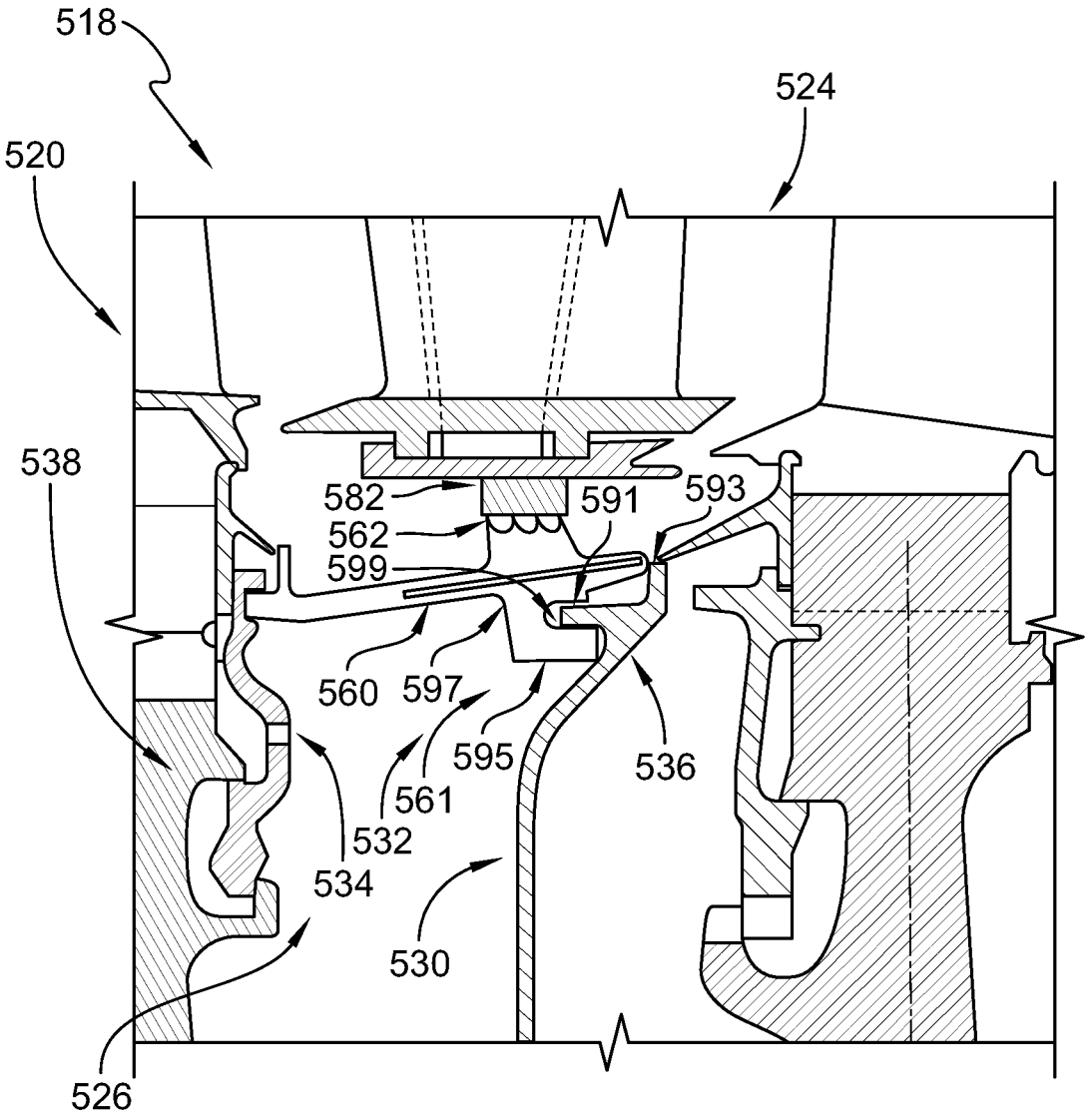
FIG. 8 is another embodiment of a turbine assembly adapted for use in the gas turbine engine of FIG. 1 showing the turbine assembly includes a vane assembly, a bladed wheel assembly, and an inner seal having a seal body, a rub band, and a mount ring that extends to and engages the bladed wheel assembly to block axial movement of the mount ring away from the bladed wheel assembly, and further showing the inner seal is segmented such that the seal body is a separate component that couples with the rub band and mount ring.

Another embodiment of a turbine assembly 518 in accordance with the present disclosure is shown in FIG. 8. The turbine assembly 518 is substantially similar to the turbine assembly 18 shown in FIGS. 2-4 and described herein. Accordingly, similar reference numbers in the 500 series indicate features that are common between the turbine assembly 18 and the turbine assembly 518. The description of the turbine assembly 18 is incorporated by reference to apply to the turbine assembly 518, except in instances when it conflicts with the specific description and the drawings of the turbine assembly 518.

The turbine assembly 518 includes a bladed wheel assembly 520, a vane assembly 524, and an inner seal 526 as shown in FIG. 8. The bladed wheel assembly 520 is adapted to interact with gases flowing through the gas path 28 of the gas turbine engine 10. The vane assembly 524 is located upstream of the bladed wheel assembly 520 and adapted to direct the gases at the bladed wheel assembly 520. The inner seal 526 is engaged with the vane assembly 524 and coupled with the bladed wheel assembly 520 for rotation therewith to block gases from passing between the inner seal 526 and the vane assembly 554 during use of the turbine assembly 518.

The inner seal 526 includes a seal body 530, a rub band 532, and a mount ring 534 as shown in FIG. 8. The seal body 530 is fastened with a disk 538 of the bladed wheel assembly 520 for rotation with the disk 538. The rub band 532 is coupled to a radial outer end 536 of the seal body 530 and engaged with the vane assembly 524 to seal between the rub band 532 and the vane assembly 524. The mount ring 534 extends axially aft and radially inward from the rub band 532.

The radial outer end 536 of the seal body 530 includes an axially extending lip 591 and a radially extending flange 593 as shown in FIG. 8. The axially extending lip 591 extends axially forward from the seal body 530. The axially extending flange 593 extends radially outward from the axially extending lip 591. The axially extending lip 591 engages the rub band 532 to couple the rub band 532 to the sealbody 530.

The rub band 532 includes a hoop 560, a lip 561, and a plurality of fins 562 as shown in FIG. 8. The hoop 560 extends circumferentially around the axis 11 and axially forward from the seal body 430. The radially inwardly extending lip 561 extends radially inward from the hoop 560 and engages the axially extending lip 591 to couple the rub band 532 with the seal body 530. The fins 562 extend radially outward from the hoop 560. In the illustrative embodiment, the hoop 560 interconnects the seal body 530 and the mount ring 534. In the illustrative embodiment, the fins 562 engage an abradable band 582 included in the vane assembly 524.

In the illustrative embodiment, the lip 561 includes a radially inwardly extending portion 595 and an axially extending portion 597 as shown in FIG. 8. The radially inwardly extending portion 595 extends radially inward from the hoop 560. The axially extending portion 597 extends axially aft away from the radially inwardly extending portion 595 to define a channel 599. The channel 599 receives the axially extending lip 591 to couple the rub band 532 to the seal body 530.

In some embodiments, the inner seal 526 may include an anti-rotation feature (not shown). The anti-rotation feature may be configured to block circumferential movement of the rub band 532 about the axis 11 relative to seal body 530. The anti-rotation feature may extend radially through the lip 591 and the axially extending portion 595 to block circumferential movement of the rub band 532 relative to the seal body 530.

Figure 9:
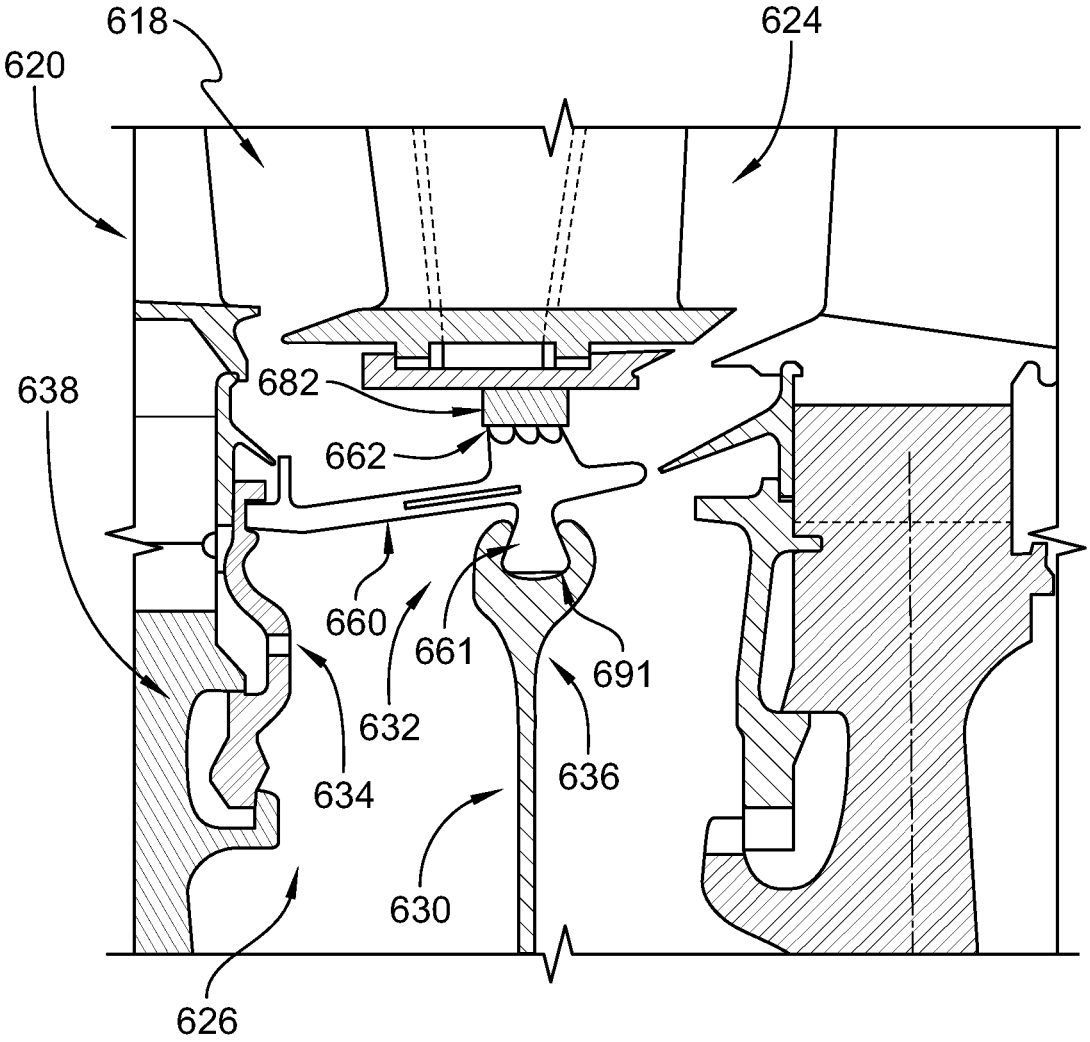
FIG. 9 is another embodiment of a turbine assembly adapted for use in the gas turbine engine of FIG. 1 showing the turbine assembly includes a vane assembly, a bladed wheel assembly, and an inner seal having a seal body, a rub band, and a mount ring that extends to and engages the bladed wheel assembly to block axial movement of the mount ring away from the bladed wheel assembly, and further showing the inner seal is segmented such that the seal body and rub band interlock at a dovetail connection.

Another embodiment of a turbine assembly 618 in accordance with the present disclosure is shown in FIG. 9. The turbine assembly 618 is substantially similar to the turbine assembly 18 shown in FIGS. 2-4 and described herein. Accordingly, similar reference numbers in the 600 series indicate features that are common between the turbine assembly 18 and the turbine assembly 618. The description of the turbine assembly 18 is incorporated by reference to apply to the turbine assembly 618, except in instances when it conflicts with the specific description and the drawings of the turbine assembly 618.

The turbine assembly 618 includes a bladed wheel assembly 620, a vane assembly 624, and an inner seal 626 as shown in FIG. 9. The bladed wheel assembly 620 is adapted to interact with gases flowing through the gas path 28 of the gas turbine engine 10. The vane assembly 624 is located upstream of the bladed wheel assembly 620 and adapted to direct the gases at the bladed wheel assembly 620. The inner seal 626 is engaged with the vane assembly 624 and coupled with the bladed wheel assembly 620 for rotation therewith to block gases from passing between the inner seal 626 and the vane assembly 654 during use of the turbine assembly 618.

The inner seal 626 includes a seal body 630, a rub band 632, and a mount ring 634 as shown in FIG. 9. The seal body 630 is fastened with a disk 538 of the bladed wheel assembly 620 for rotation with the disk 638. The rub band 632 is coupled to a radial outer end 636 of the seal body 630 and engaged with the vane assembly 624 to seal between the rub band 632 and the vane assembly 624. The mount ring 634 extends axially aft and radially inward from the rub band 632.

The radial outer end 636 of the seal body 630 is shaped to include an attachment channel 691 as shown in FIG. 8. The attachment channel 691 extends into the radial outer end 636 of the seal body 630 and is sized to receive a portion of the rub band 632.

The rub band 632 includes a hoop 660, a root 661, and a plurality of fins 662 as shown in FIG. 9. The hoop 660 extends circumferentially around the axis 11 and axially forward from the seal body 630. The root 661 extends radially inward from the hoop 660 and into the attachment channel 691. The fins 562 extend radially outward from the hoop 660. In the illustrative embodiment, the fins 662 engage an abradable band 682 included in the vane assembly 624.

In some embodiments, the inner seal 626 may include an anti-rotation feature (not shown). The anti-rotation feature may be configured to block circumferential movement of the rub band 632 about the axis 11 relative to seal body 630. The anti-rotation feature may be a pin that extends between the root 661 and the radial outer end 636 of the seal body 630 to block circumferential movement of the rub band 632 relative to the seal body 630.

This present disclosure relates to reducing the complexity of a ceramic matrix composite component or vane 66 by removing structural loads and additional seals from the vane assembly 24. Removing the structural loads and seals from the vane assembly 24, ensures the primary function of the ceramic matrix composite vane 66 is achieved with maximum efficiency. It may also allow easier stiffness control by linking metallic components to get structural optimization of the vane assembly 24.

In some embodiments, the inner sealing between stages in some gas turbine engines may be achieved by mounting abradable material directly to a vane component or mounting an abradable back plate/hanger to a vane component. In a ceramic matrix composite subsystem, such an arrangement may involve multiple metallic to ceramic joints, which are inherently difficult to seal given the large coefficient of thermal expansion mismatch. As such, the present disclosure includes a full metallic structure 68 supporting the static part such as an abradable band 82 of the inner seal 26, a vane 66 in contact with the hot gases in the gas path 28, and minimal joints or interactions between the two materials In some embodiments, in an inner seal may be used to prevent excessive secondary air system flow leakage between stages. In the illustrative embodiment, the turbine assembly 18 includes a rotating inner seal 26 that engages with a metallic support structure 68, 70 of the turbine vane assembly 24. A portion of the metallic support structure 68 extends through the ceramic matrix composite vane 66, allowing the vane 66 to be supported at the inner and outer interfaces, reducing stresses.

The present disclosure teaches an abradable band 82 applied to the underside 84 of the metallic support structure 70. The abradalble band 82 acts as the interface to the rotating seal fins 62.

In the illustrative embodiment, the inner seal 26 may be installed on a mini-disk 38 or cantilevered from either bladed rotating wheel assemblies 20, 22. If the metal outer support 68 is hollow, then an optional split seal arrangement to allow pressurized air flow to transit from outer to inner cavities.

In some embodiments, the inner support 70 may be an annular ring or segmented part as shown in FIG. 3. In either case, the inner support 70 may be rigidly restrained by the outer support 68 that extends through the vane 66.

If the inner support 70 is segmented, the vane assembly 24 may include strip seals between adjacent supports 70. Careful consideration of the compliance of this system may be desired to ensure adequate sealing across the engine operating envelope.

In the illustrative embodiment of FIG. 5, the inner support 270 may extend and form the inner platform 276 of the vane 266 and reduce the complexity in the ceramic vane 266. If metallic platforms are incorporated, sealing the interface between the ceramic materials and the metallic materials may be considered. However, if the ceramic vane 266 is radially constrained at the inner support 270, then the relative movements at the seal interface may be minimised.

In the illustrative embodiment of FIG. 6, the inner seal 326 includes an additional row of fins 364. The additional fins 364 at the forward end of the vane 366 allows for an intermediate zone pressure to be created in the inboard disk cavity (i.e. to the left of the mini-disk 338). Such an arrangement may include alterative sealing flow source to provide rim sealing. The alternative sealing flow source may be compressor delivery air transmitted through the disc head or through the disc bore.

In the illustrative embodiment of FIG. 7, the inner seal 426 includes a pre-swirl nozzle 472 at the inner extend of the vane assembly 424. The nozzle 472 may have an abradable band 482 coupled to the body 492 of the nozzle 472. In the illustrative embodiment, the spout 494 also includes an abradable band 484.

The axial loading from the pre-swirl nozzle 472 may counteract a proportion of the pneumatic load on the increased radial extent of the outer support 468 and the inner support 470. By pre-swirling, the windage losses may be reduced in the disc cavity The life of the ceramic matrix composite vane 66, 266, 366, 466 may be unaffected by changes in the metallic support structure design. Therefore, the metallic support structure may be optimized for maximum efficiency. It also allows quick tuning of the fits, joints, thicknesses, and materials during a development. Additional joints/linkages may be applied to the metallic structure, around the outside of the ceramic vane 66, 266, 366, 466.

In some embodiments, the turbine assembly 18, 218, 318, 418, 518, 618 may include a turbine case cooling system. The cooling system may be configured to selectively supply cooling air to the bladed wheel assemblies 20, 22, 222, 322, 422, 520, 620 to control the tip clearance of the blades 40. The cooling system may also be configured to selectively supply cooling air to the vane assembly 24, 224, 324, 424, 524, 624 to manage the temperature and diameter of the outer and inner supports 66, 70, 266, 270, 366, 370, 466, 470. The flow of cooling air supplied may be varied to alter the tip clearance or the inner seal clearance throughout the flight cycle.

In the illustrative embodiment, the seal body 30 includes a hole that extends axially through the seal body 30. The hole may allow tooling access for pushing and/or pre-leaning the seal body 30 before fastening the fasteners 81.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine assembly for use with a gas turbine engine, the turbine assembly comprising:

a bladed wheel assembly adapted to interact with gases flowing through a gas path of the gas turbine engine such that the gases push the bladed wheel assembly to rotate about an axis during use of the turbine assembly, the bladed wheel assembly including a disk arranged around the axis and a plurality of blades that extend radially from the disk, a vane assembly located upstream of the bladed wheel assembly and adapted to direct the gases at the bladed wheel assembly, the vane assembly being fixed relative to the axis and including a vane and an inner support, the vane includes an outer platform, an inner platform spaced apart radially from the outer platform relative to the axis, and an airfoil that extends radially between the outer platform and the inner platform, and the inner support located radially inward of the inner platform and coupled with the vane, and an inner seal engaged with the inner support and coupled with the disk of the bladed wheel assembly for rotation with the disk about the axis to block gases from passing between the inner seal and the vane assembly during use of the turbine assembly, the inner seal includes a radially and circumferentially extending seal body fastened with the disk for rotation with the disk, a rub band coupled to a radial outer end of the seal body and engaged with the inner support to seal between the rub band and the inner support, and a mount ring that extends axially aft and radially inward from the rub band, wherein the mount ring is interlocked with the disk to form a bayonet fitting with the disk that blocks axial movement of the mount ring away from the disk and that transmits a portion of the radial force loads caused by rotation of the inner seal to the disk to reduce a magnitude of the radial force loads carried by the seal body, wherein the disk includes a disk body arranged circumferentially around the axis, an outer flange that extends axially forward from the disk body to define a radially outward opening channel, and a radially inwardly facing shoulder located radially outward of the outer flange that extends circumferentially around the axis, the mount ring extends radially inward into the channel and is configured to engage the outer flange so that axial movement of the mount ring is blocked by the outer flange, and wherein the mount ring includes a radially outward facing shoulder that engages the radially inward facing shoulder of the disk to transmit the portion of the radial force loads in a radial direction.

2. The turbine assembly of claim 1, wherein the outer flange is castellated to define a plurality of disk grooves that extend radially inward into the outer flange and the mount ring is castellated to define a plurality of grooves that extend radially outward into the mount ring.

3. The turbine assembly of claim 1, wherein the disk includes an inner flange located radially inward of the outer flange, the inner flange extends axially forward from the disk body, and the seal body is fastened with the inner flange for movement with the inner flange.

4. The turbine assembly of claim 1, wherein the rub band includes a hoop that extends circumferentially around the axis and axially aft of the seal body and a plurality of fins that extends radially outward from the hoop and the hoop interconnects the seal body and the mount ring.

5. The turbine assembly of claim 1, wherein the inner platform and the inner support are integrally formed as a single, one-piece component that is separate from the outer platform and the airfoil.

6. The turbine assembly of claim 1, wherein the rub band includes a hoop, a plurality of forward fins that extend radially outward from the hoop, and a plurality of aft fins that extend radially outward from the hoop, the hoop extends circumferentially around the axis and is coupled with a radial terminal end of the seal body, the plurality of aft fins are spaced apart axially from the plurality of forward fins to define an annular chamber therebetween, and the hoop is formed to define a hole that extends radially through the hoop and opens into the annular chamber.

7. The turbine assembly of claim 1, wherein the inner support is a full hoop and formed to define passageways that each extend radially inward into the inner support and turn axially aft and open into an aft facing surface of the inner support to cause the inner support to act as a pre-swirl nozzle configured to deliver pressurized air to the disk.

8. The turbine assembly of claim 1, wherein the radially inwardly facing shoulder extends continuously around the axis.

9. A turbine assembly for use with a gas turbine engine, the turbine assembly comprising:

a first bladed wheel assembly that includes a disk arranged around an axis and a plurality of blades that extend radially from the disk, a vane assembly that includes a vane and an inner support coupled with the vane and located radially inward of the vane, and an inner seal that includes a seal body that extends circumferentially about the axis, a rub band that extends axially away from a radial outer end of the seal body, and a mount ring that extends radially inward from the rub band, the seal body is coupled with the disk of the first bladed wheel assembly, and the mount ring interlocks with the disk so that the mount ring is blocked from moving axially away from the disk of the first bladed wheel assembly, wherein the mount ring is interlocked with the disk of the first bladed wheel assembly to transmit a portion of radial force loads caused by rotation of the inner seal to the disk, the disk includes a disk body arranged circumferentially around the axis and a radially inwardly facing shoulder that extends axially forward from the disk body and circumferentially around the axis, and the mount ring includes a radially outward facing shoulder that engages the radially inward facing shoulder of the disk to transmit the portion of the radial force loads in a radial direction, and wherein the turbine assembly further comprises a second bladed wheel assembly spaced apart axially from the first bladed wheel assembly to locate the inner seal between the first and second bladed wheel assemblies and the seal body of the inner seal is the only portion of the inner seal that engages a disk included in the second bladed wheel assembly.

10. The turbine assembly of claim 9, wherein the mount ring includes a lip and a plurality of tabs that extend radially inward from the lip, the disk of the first bladed wheel assembly is formed to include a flange having an arm and a plurality of tabs that extend from the arm, and the plurality of tabs of the mount ring are aligned with the plurality of tabs of the flange to interlock the inner seal with the disk of the first bladed wheel assembly.

11. The turbine assembly of claim 10, wherein the disk of the first bladed wheel assembly is formed to include a first plurality of fastener holes arranged circumferentially around the axis and the seal body is formed to include a second plurality of fastener holes arranged circumferentially around the axis so that the plurality of tabs of the mount ring are aligned with the plurality of tabs of the flange in response to the fastener holes formed in the seal body being aligned with the fastener holes formed in the disk of the first bladed wheel assembly.

12. The turbine assembly of claim 9, wherein the rub band includes a hoop, a forward fin that extends radially away from the hoop and engages the vane assembly, and an aft fin that extends radially away from the hoop and engages the vane assembly, and the hoop is formed to define a plurality of holes that extend radially through the hoop between the forward fin and the aft fin.

13. The turbine assembly of claim 9, wherein the vane assembly includes an outer platform, an airfoil that extends radially inward from the outer platform, and the inner support includes an inner platform and an inner carrier located radially inward of the inner platform.

14. The turbine assembly of claim 9, wherein the rub band extends only in a single axial direction away from the radial outer end of the seal body.

15. The turbine assembly of claim 9, wherein the radially inwardly facing shoulder extends continuously around the axis.

16. A method comprising:

providing a bladed wheel assembly arranged around an axis, a vane assembly, and an inner seal, the bladed wheel assembly including a disk arranged around the axis, and the disk including a disk body arranged circumferentially around the axis and a radially inwardly facing shoulder that extends axially forward from the disk body and circumferentially around the axis, locating the vane assembly axially adjacent the bladed wheel assembly, aligning the inner seal with the disk along the axis, translating axially the inner seal relative to the disk to cause the inner seal to align axially with and engage the vane assembly, rotating the inner seal relative to the disk partway about the axis to cause the inner seal to interlock with the disk after the translating step, fixing the inner seal with the disk for rotational movement with the disk after the rotating step, and transmitting a portion of the radial force loads caused by rotation of the inner seal to the disk to reduce a magnitude of the radial force loads carried by the inner seal, wherein the inner seal includes a radially outward facing shoulder that engages the radially inward facing shoulder of the disk to transmit the portion of the radial force loads in a radial direction relative to the axis, wherein the inner seal includes a seal body that extends circumferentially about the axis, a rub band that extends axially aft away from a radial outer end of the seal body, and a mount ring that extends radially inward from the rub band and where rotating the inner seal relative to the disk causes the mount ring to interlock with the disk to form a bayonet fitting with the disk that blocks axial movement of the mount ring away from the disk.

17. The method of claim 16, wherein the fixing step includes inserting fasteners into the inner seal and the bladed wheel assembly so that that inner seal is blocked from rotating relative to the bladed wheel assembly.

18. The method of claim 17, wherein the vane assembly includes a vane and a pre-swirl nozzle coupled to a radial inner end of the vane and the method further includes engaging the inner seal with the pre-swirl nozzle and directing pressurized air radially through the vane, through the pre-swirl nozzle, and axially toward the disk via an outlet of the pre-swirl nozzle.

19. The method of claim 17, wherein the rub band includes a hoop, a forward fin that extends radially away from the hoop and engages the vane assembly, and an aft fin that extends radially away from the hoop and engages the vane assembly, and the hoop is formed to define a plurality of holes that extend radially through the hoop between the forward fin and the aft fin.

20. The method of claim 16, wherein the seal body is fastened with the disk of the bladed wheel assembly.

* * * * *